US009004227B2

(12) United States Patent
Chilton

(10) Patent No.: US 9,004,227 B2
(45) Date of Patent: Apr. 14, 2015

(54) LADDER ACCESS SYSTEM AND METHOD FOR USING SAME

(75) Inventor: Ronald W. Chilton, Conroe, TX (US)

(73) Assignee: National Trench Safety, LLC, Houston, TX (US)

( * ) Notice: Subject to any disclaimer, the term of this patent is extended or adjusted under 35 U.S.C. 154(b) by 741 days.

(21) Appl. No.: 13/012,913

(22) Filed: Jan. 25, 2011

(65) Prior Publication Data

US 2012/0186066 A1 Jul. 26, 2012

(51) Int. Cl.
*E06C 7/48* (2006.01)
*E06C 7/18* (2006.01)

(52) U.S. Cl.
CPC .. *E06C 7/48* (2013.01); *E06C 7/182* (2013.01)

(58) Field of Classification Search
USPC ..... 182/83
See application file for complete search history.

(56) References Cited

U.S. PATENT DOCUMENTS 5,148,889 A * 9/1992 Fenwick et al. ..... 182/17
6,533,069 B1 * 3/2003 Couillard ..... 182/83
6,830,127 B2 * 12/2004 Johnson ..... 182/113
6,907,957 B1 6/2005 Couch
6,931,793 B2 * 8/2005 Joyce et al. ..... 52/20
8,397,868 B1 * 3/2013 Ferree ..... 182/116
2004/0031645 A1 * 2/2004 Sheppard et al. ..... 182/131
2007/0175699 A1 8/2007 Steblinski
2009/0000868 A1 * 1/2009 Gaines ..... 182/106

* cited by examiner

*Primary Examiner* — Alvin Chin-Shue

(74) *Attorney, Agent, or Firm* — Edmonds & Nolte, P.C.

(57) ABSTRACT

Embodiments of the disclosure may provide a ladder access system. The ladder access system may include a base having a clamp disposed proximal an excavation end thereof. The clamp may be configured to secure the base to an excavation support structure. A first side rail may be disposed on a first side of the base and a second side rail may be disposed on a second side of the base. The ladder access system may also include a gate disposed at a surface end of the base and extending between the first and second side rails. The ladder access system may further include a ladder support disposed proximal the excavation end of the base and extending from the first or second side rail, the ladder support being configured to uphold an upper end of a ladder disposed in an excavation and leaning thereupon.

10 Claims, 1 Drawing Sheet

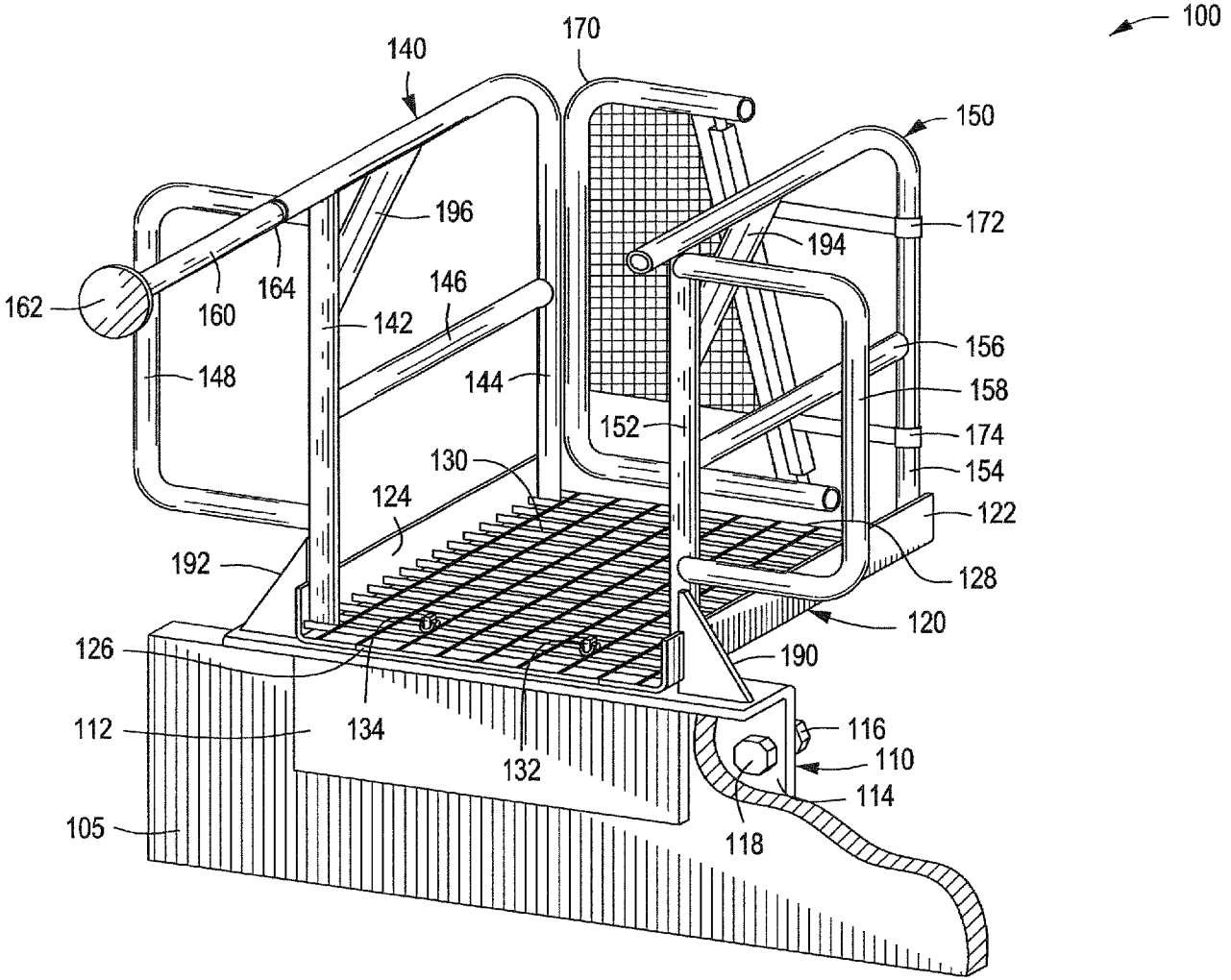
100
150
172
156
158
174
154
122
128
120
116
110
114
118
190
194
152
170
132
144
130
196
146
140
142
124
134
164
160
148
192
126
112
105
162

LADDER ACCESS SYSTEM AND METHOD FOR USING SAME

BACKGROUND

1. Field

Embodiments of the present disclosure generally relate to fall prevention. More particularly, such embodiments relate to excavation site fall protection.

2. Description of the Related Art

In the United States, falls make up over one-third of all construction fatalities. Over 250,000 non-fatal injuries from falls occurred in 2007 alone. The Code of Federal Regulations (CFR) specifies that an employer must utilize a fall protection system whenever an employee may fall 1.8 m (6 ft) or more from any surface. Additionally, at an edge of an excavation, well, pit, shaft, hole, or the like, that is 1.8 m or more in depth and is not readily visible, employees must be protected from falls by guardrail systems, fences, barricades, or covers as appropriate. A stairway or ladder must be provided at all personnel points of access used with fall protection systems for an excavation, and the points of access must have a gate or be offset so that a person cannot walk directly into the excavation. When portable ladders are used for access to an upper landing surface, the ladder side rails must extend at least 0.9 m (3 ft) above the upper landing surface to which the ladder is used to gain access.

Conventional excavation access ladder systems often lack a gate or a way for ladders to extend above the upper landing surface. In addition, such access ladder systems are often unwieldy or site specific, i.e., not adaptable to varying excavation sites.

There is a need, therefore, for a ladder access system that meets current safety standards, is easily movable, and/or is easily attachable to excavation site fixtures or structures.

SUMMARY

Embodiments of the disclosure provide a ladder access system. The ladder access system may include a base having a clamp disposed proximal an excavation end thereof. The clamp may be configured to secure the base to an excavation support structure. A first side rail may be disposed on a first side of the base and a second side rail may be disposed on a second side of the base. The ladder access system may also include a gate disposed at a surface end of the base and extending between the first and second side rails. The ladder access system may further include a ladder support disposed proximal the excavation end of the base and extending from the first or second side rail, the ladder support being configured to uphold an upper end of a ladder disposed in an excavation and leaning thereupon.

Embodiments of the disclosure may further provide a ladder access system generally including a clamp disposed on a base proximal an excavation end of the base. The clamp may have an excavation side and a surface side adapted to extend over an excavation support structure such that the excavation support structure is interposed therebetween. A biasing device may be coupled to the surface side of the clamp and configured to place the excavation side in biasing engagement with a front side of the excavation support structure, thereby securing the clamp thereto. A first side rail may be disposed on a first side of the base and a second side rail may be disposed on a second side of the base. A gate may be disposed proximal a surface end of the base and extending between the first and second side rails. The ladder access system may also include a ladder support disposed proximal the excavation end of the base and extending from the first or second side rail, the ladder support being configured to uphold an upper end of a ladder disposed in an excavation and leaning thereupon. A stop may be disposed on an end of the ladder support, the stop being configured to prevent a ladder from sliding off the ladder support.

Embodiments of the disclosure may further provide a method for preventing falls from ladder access points in an excavated area. The method generally includes disposing an excavation side of a clamp on a front side of an excavation support structure, the clamp being secured to a base proximal an excavation end of the base. The base may have first and second side rails disposed on opposing sides of the base and a gate disposed on one of the side rails adjacent a surface end of the base. The method also includes disposing a surface side of the clamp proximate a back side of the excavation support structure such that excavation support structure is at least partially interposed between the excavation and surface sides of the clamp. The method may further include securing the clamp to the excavation support structure and securing a ladder support to one of the side rails proximal the excavation end of the base.

BRIEF DESCRIPTION OF THE DRAWINGS

The present disclosure is best understood from the following detailed description when read with the accompanying FIGURE. It is emphasized that, in accordance with the standard practice in the industry, various features are not drawn to scale. In fact, the dimensions of the various features may be arbitrarily increased or reduced for clarity of discussion.

The FIGURE depicts an isometric view of an illustrative ladder access system, according to one or more embodiments described.

DETAILED DESCRIPTION

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the FIGURE provided herein. This repetition is for the purpose of simplicity and clarity and does not in itself dictate a relationship between the various exemplary embodiments and/or configurations discussed in the FIGURE. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

The FIGURE depicts an isometric view of an illustrative ladder access system 100, according to one or more embodiments. The ladder access system 100 provides an access point to an excavation (not shown) and support for a ladder disposed in the excavation that meets Occupational Safety and Health Administration (OSHA) regulations. The ladder access system 100 may be implemented with a fall protection system (not shown), e.g., a safety rail system, fence, barricade, or the like.

The ladder access system 100 generally includes a base 120 having a clamp 110 disposed on or otherwise coupled thereto at or proximal an excavation end of the base 120. In one embodiment, the clamp 110 is generally configured to secure the ladder access system 100 to an excavation support structure 105, e.g., a trench shoring wall, a trench shield wall, an aluminum trench box wall, a shoring panel, a slide rail panel, combinations of the same, or the like. The clamp 110 may have a first or "excavation" side 112 and a second or "surface" side 114. The excavation side 112 may be longer or shorter than the surface side 114, as desired. As illustrated, the excavation side 112 is generally configured to interface with or be disposed adjacent a front side of the excavation support structure 105, and the surface side 114 is generally configured to interface with or be disposed adjacent a back side of the excavation support structure 105. In a least one embodiment, the excavation support structure 105 may be at least partially interposed between the excavation side 112 and the surface side 114 of the clamp 110. It should be noted that "front side," as used herein, generally refers to an excavation side of the ladder access system 100, or in other words the side of the system 100 where the ladder will be disposed during operation. Moreover, "back side" as used herein refers to a walking level or upper landing surface side of an excavation.

The excavation side 112 may serve as a backer element for the clamp 110 and the surface side 114 may support one or more biasing devices (one is shown 116). In one embodiment, the biasing device 116 is generally disposed on or through the surface side 114 of the clamp 110 and configured to provide biasing engagement with the back side of the excavation support structure 105. For example, the biasing device 116 may be configured to force a first or biasing end 118 against the back side of the excavation support structure 105 to pull or otherwise adjust the excavation side 112 into biasing engagement with the front side of the excavation support structure 105, thereby securing the clamp 110 thereto. In at least one embodiment, the biasing device 116 may be a screw-like device threadably engaged with a perforation (not shown) defined in the surface side 114. As such, rotating or screwing the biasing device in a first direction may serve to advance the biasing end 118 toward the back side of the excavation support structure 105. Rotating or screwing the biasing device 116 in a second or opposing direction may serve to release the biasing pressure and loosen the biasing device 116 from engagement with the excavation support structure 105. Alternatively, the surface side 114 may serve as the backer element for the clamp 110, the excavation side 112 may support the one or more biasing devices 116, and the biasing device 116 may be disposed on or through the excavation side 112 of the clamp 110 and configured to provide biasing engagement with the front side of the excavation support structure 105.

As illustrated, the biasing end 118 may include a substantially flat surface configured to be biased against the excavation support structure 105. It will be appreciated, however, that the biasing end 118 may include a variety of other shapes and configurations without departing from the scope of the disclosure. For instance, the biasing end 118 may include a rounded point instead of a flat surface, and nonetheless provide sufficient biasing engagement.

The base 120 may be secured to the clamp 110 by suitable fasteners such that the excavation side 112 and the surface side 114 of the clamp 110 are substantially perpendicular to the base 120. For example, suitable fasteners include, but are not limited to, welds, pins, rivets, nuts and bolts, screws, nails, or any combination thereof. In at least one embodiment, the base 120 may be configured to be positioned at least partially over the excavation support structure 105.

In at least one embodiment, the base 120 is generally rectangular and includes a first side 122 and a second side 124 joined by a front cross beam 126 and a back cross beam 128. The front cross beam 126 forms an excavation end of the base 120 and the back cross beam 128 forms a surface end of the base 120. As illustrated, the first and second sides 122, 124 may be "L" shaped or otherwise bent vertically at their perimeter for safety and/or for structural support of other members of the ladder access system 100. In at least one embodiment, the front cross beam 126 may be flush with the excavation side 112 of the clamp 110.

A floor 130 may be disposed on or inside the base 120 between the first side 122 and second side 124. The floor 130 may be solid, slotted, or include a grating. In at least one embodiment, the floor 130 can be removable from the base 120 and/or extendable from the base 120. For example, the floor 130 may be extended from the base 120 toward the front side of the excavation support structure 105. One or more eyelets (two are shown 132, 134) may be fastened to the base 120 and/or to the clamp 110 and disposed through openings defined in the floor 130. The eyelets 132, 134 may be used to attach lifting and/or rigging equipment (e.g., a slings, chains, cables, or the like) thereto in order to lift, transport, and/or position the ladder access system 100.

A first side rail 140 and a second side rail 150 may be disposed on or otherwise secured to the first and second sides 122, 124, respectively. For example, the first and second side rails 140, 150 may be welded, pinned, riveted, bolted, screwed, or nailed to the first and second sides 122, 124, respectively. The side rails 140, 150 may include front posts 142, 152, respectively, secured to the first and second sides 122, 124 proximate the front of the ladder access system 100. In at least one embodiment, the front posts 142, 152 may be secured directly to the clamp 110.

One or more base gussets (two are shown 190, 192) may be secured to the respective front posts 142, 152, the sides 122, 124 of the base 120, and/or the clamp 110. The base gussets 190, 192 may be welded, screwed, or bolted to the respective front posts 142, 152, the sides 122, 124 of the base 120, and/or the clamp 110 to provide extra support and/or rigidity to the ladder access system 100.

The side rails 140, 150 may also include railings 144, 154 having substantially horizontal portions and substantially vertical portions. The substantially horizontal portions of the railings 144, 154 may be secured to the top of the front posts 142, 152, respectively, and may join the substantially vertical portions that may be secured or otherwise coupled to the distal ends of the sides 122, 124, respectively. One or more side rail gussets (two are shown 194, 196) may be secured between the front posts 142, 152 and the railings 144, 154 to provide support therebetween.

Midrails 146, 156 may be disposed between the front posts 142, 152 and the substantially vertical portions of the railings 144, 154. The midrails 146, 156 may be substantially horizontal and/or may be disposed midway between the base 120 and a top of the side rails 140, 150. It is also contemplated that the midrails 146, 156 be disposed at a variety of angular configurations, without departing from the scope of the disclosure. Although not shown, other midrails may be added to the side rails 140, 150 above or below the illustrated midrails 146, 156.

The front posts 142, 152, the railings 144, 154, and/or the midrails 146, 156 may be of the same or different cross-sectional shape and/or material. For example, the front posts 142, 152, the railings 144, 154, and/or the midrails 146, 156 may be circular pipe, tubular steel (e.g., square shaped pipe with rounded or chamfered edges), solid steel or iron, or any combination thereof. The front posts 142, 152, the railings 144, 154, and/or the midrails 146, 156 may be secured to one another with suitable fasteners including, but not limited to, welds, pins, rivets, nuts and bolts, screws, nails, or any combination thereof.

One or more gap filling rails 148, 158 may be disposed on the front and/or back side of the side rails 140, 150. For example, a first gap filling rail 148 may be disposed on the front post 142 of the first side rail 140 and may extend perpendicularly from the side rail 140 away from the base 120. A second gap filling rail 158 may be disposed on the front post 152 of the second side rail 150 and may extend perpendicularly from the second side rail 150 away from the base 120. The gap filling rails 148, 158 may provide extra fall protection around the gate 170, especially on an edge of the excavation. As will be appreciated, the gap filling rails 148, 158 may be configured to attach to other safety structures, e.g., guardrail systems, barricades, fences, or the like, and/or fill gaps between the ladder access system 100 and those other safety structures.

The height of the side rails 140, 150 from the base 120 may vary, but may be at a sufficient height to meet OSHA regulations. For example, the height of the side rails 140, 150 from the base 120 may range from a low of about 100 cm, about 102 cm, about 104 cm, about 106 cm, or about 108 cm to a high of about 112 cm, about 114 cm, about 116 cm, about 118 cm, or about 120 cm above the base 120.

Although the front posts 142, 152, the railings 144, 154, the midrails 146, 156, and/or the gap filling rails 148, 158 of the side rails 140, 150 are shown as separate pieces, they all may be formed of one piece. For example, the side rails 140, 150 may each be a uniform or integral piece of metal, plastic, fiberglass, or the like.

A ladder support 160 is generally disposed proximal an excavation end of at least one of the side rails 140, 150. In operation, the ladder support 160 provides a surface or resting area where the upper end of a ladder may be leaned while the lower end of the ladder extends into the excavation site. In at least one embodiment, the ladder support 160 is an integral, elongate extension of one of the side rails 140, 150. In other embodiments, however, the ladder support 160 may be a separate and distinct member that is added or otherwise coupled to the system 100 by extending one of the substantially horizontal portions of the railings 144, 154.

The ladder support 160 may be either permanently or removably attached to one of the side rails 140, 150. For example, the ladder support 160 may be threaded, latched, or compression fit into one of the side rails 140, 150 to provide removable attachment of the ladder support 160. In another example, a second end 164 of the ladder support 160 may be inserted into one of the side rails 140, 150 and secured thereto using a variety of mechanical fastening devices, such as extending a pin through one or more holes formed through the applicable side rail 140, 150. Although not shown, the ladder support 160 may be extendable, e.g., telescoping.

The ladder support 160 generally has a stop 162 disposed at a first end thereof and configured to prevent a ladder (not shown) from translating laterally, e.g., sliding or slipping off the ladder support 160, and the second end 164 configured to attach to at least one of the side rails 140, 150 as described above. For example, the stop 162 can prevent an improperly placed ladder from sliding off the ladder support 160. As illustrated, the stop 162 may include a plate disposed or otherwise formed thereon with a larger cross-sectional area than the ladder support 160 to prevent the ladder (not shown) from sliding off the end of the ladder support 160. In other embodiments, however, the stop 162 may include any type of device that may be disposed on the ladder support 160 to prevent a ladder from slipping off and into the excavation site. For example, the stop 162 may include a block, groove, latch, hook, or combinations thereof, without departing from the scope of the disclosure.

The ladder support 160 may be configured to support a ladder resting thereupon up to at least the height of the side rails 140, 150. For example, the ladder support 160 may be disposed at a height of about 0.9 m or more above the level of the base 120 and configured to support the ladder to at least that height. For example, the ladder support 160 may be disposed at a height of from about 0.5 m to about 2 m, about 0.6 m to about 1.5 m, or about 0.7 m to about 1 m. It will be appreciated, however, that this height may vary to fit a particular application, without departing from the disclosure.

Although not shown, the ladder support 160 may include one or more fasteners, fastening systems, or combinations of fasteners and/or fastening systems adapted to secure a ladder thereto. For example, the ladder support 160 can include one or more tie downs or other anchoring members suitable for receiving an elongated member such as a rope, cable, chain, or the like connected to the ladder, thereby securing the ladder to the ladder support 160.

The ladder access system 100 may further include a gate 170 generally disposed at or near a surface end of the base 120. As illustrated, a first or "upper" hinge 172 and a second or "lower" hinge 174 may be secured to the back of one of the side rails 140, 150. For example, the hinges 172, 174 may be secured to either of the substantially vertical portions of the railings 144, 154. As will be appreciated, the gate 170 may be of a variety of shapes and sizes without departing from the scope of the disclosure. In one embodiment, the gate 170 may be a solid piece or may include an outer frame having intermediate members (e.g., screens, mesh, vertical rails, horizontal rails, or the like) disposed thereon. In at least one embodiment, the gate 170 may be a self-closing gate. For example, the hinges 172, 174 may be spring hinges or may be set at an angle to bias the gate 170 towards a closed position. In another example, the gate 170 may be weighted to automatically return to a closed position. In at least one embodiment, the gate 170 may be secured to either of the first and second side rails 140, 150 before or after the clamp 110 is secured to the excavation support structure 105.

Any or all of the components of the ladder access system 100 described above may be made of a suitable material that meets OSHA standards. Such suitable materials may include, but are not limited to, metals, fiberglass, wood, composite materials, and plastics, as well as mixtures, blends, and copolymers of any and all of the foregoing materials.

In operation, the ladder access system 100 may be transported to an excavation having an excavation support structure 105 disposed therein. The ladder access system 100 may be disposed on and secured to the excavation support structure 105. To transport and dispose the ladder access system 100 onto the excavation support structure 105, chains and/or hooks may be secured to the eyelets 132, 134. The ladder access system 100 may then be lowered onto the excavation support structure 105. Specifically, the excavation side 112 and the surface side 114 of the clamp 110 may be placed proximate either side of the excavation support structure 105 so that the clamp 110 rests thereon. It will be appreciated that one or more persons may manually move the ladder system 100 into position, if weight of the ladder access system 100 permits.

Once the clamp 110 is in the desired position, it may be secured to the excavation support structure 105 using the one or more biasing devices 116. For example, the biasing device 116 may be rotated to bias the substantially flat first end 118 against the excavation support structure 105, thereby compressing or otherwise clamping the excavation support structure 105 between the first end 118 and the excavation side 112 of the clamp 110. It will be appreciated that two or more biasing devices 116 may be used to secure the clamp 110 to the excavation support structure 105. Because of the variable length of each biasing device 116, and therefore its ability to clamp at various widths, the ladder access system 100 may be appropriately adjusted and/or configured to fit on a variety of excavation support structures 105 having various dimensions.

The ladder support 160 may be secured to one of the side rails 140, 150 before or after the clamp 110 is secured, as desired. For example, after the clamp 110 has been secured, a ladder support 160 may be secured to either or both of the side rails 140, 150 by placing the second end 164 of the ladder support 160 into an opening in the side rails 140, 150 (e.g., in a circular opening in one of the railings 144, 154) and pinning, screwing, or bolting the ladder support 160 to one of the side rails 140, 150.

Once the ladder support 160 is secured to either of the side rails 140, 150, a ladder (not shown) may be disposed in the excavation adjacent the excavation support structure 105, and an end of the ladder may be placed in the excavation to lean on or otherwise bias against the ladder support 160. The ladder may be secured to the ladder support 160 using any suitable means, e.g., by wrapping a chain, rope, cord, clamps, or the like about the ladder support 160 and the end of the ladder.

Once the ladder is secured to the ladder support 160, the gate 170 can provide safe and controlled access to the ladder and thereby to the interior of the excavation. It will be appreciated that the ladder access system 100 may be implemented in concert with other fall protection systems, e.g., guardrails, barricades, fences, personal fall arrest systems, or the like, and may be connected thereto, as desired. For example, the gap filling rails 148, 158 may be connected to rails of adjacent guardrails (not shown). If an access point is no longer needed, the biasing device(s) 116 of the clamp 110 may be loosened to free the ladder access system 100 to be moved elsewhere or stored.

Although not shown, two or more ladder access systems 100 may be disposed along the excavation support structure 105. For example, a plurality of ladder access systems 100 can be located a predetermined distance from one another to provide a plurality of access points into the excavation site. In at least one example, two adjacent ladder access systems 100 can be located about 1 ft, about 5 ft, about 10 ft, about 20 ft, about 25 ft, about 30 ft, about 35 ft, about 40 ft, about 45 ft, or about 50 ft from one another along the excavation support structure 105. In at least one other example, two adjacent ladder access systems 100 can be located from one another a distance of less than about 50 ft, less than about 40 ft, less than about 30 ft, less than about 25 ft, less than about 20 ft, or less than about 10 ft.

Embodiments of the present disclosure further relate to any one or more of the following paragraphs:

1. A ladder access system, comprising: a base having a clamp disposed proximal an excavation end thereof, the clamp being configured to secure the base to an excavation support structure; a first side rail disposed on a first side of the base and a second side rail disposed on a second side of the base; a gate disposed at a surface end of the base and extending between the first and second side rails; and a ladder support disposed proximal the excavation end of the base and extending from the first or second side rail, the ladder support being configured to uphold an upper end of a ladder disposed in an excavation and leaning thereupon.

2. The ladder access system of paragraph 1, wherein the clamp has an excavation side configured to be disposed adjacent a front side of the excavation support structure and a surface side configured to be disposed adjacent a back side of the excavation support structure.

3. The ladder access system of paragraph 2, wherein the surface side of the clamp comprises a biasing device configured to place the excavation side in biasing engagement with the front side of the excavation support structure, thereby securing the clamp thereto.

4. The ladder access system according to any one of paragraphs 1 to 3, further comprising a floor disposed on the base.

5. The ladder access system of paragraph 4, wherein the floor is removable.

6. The ladder access system of paragraph 4 or 5, wherein the floor comprises grating.

7. The ladder access system according to any one of paragraphs 1 to 6, wherein the ladder support is an elongate member having a first end and a second end, the second end being removably secured to the first or second side rail.

8. The ladder access system of paragraph 7, wherein the first end of the ladder support has a stop disposed thereon configured to prevent the ladder from sliding off the ladder support.

9. The ladder access system according to any one of paragraph 1 to 8, wherein the ladder support is disposed at a height of about 0.9 meters or more above a level of the base.

10. The ladder access system according to any one of paragraphs 1 to 9, further comprising one or more eyelets secured to the clamp.

11. The ladder access system according to any one of paragraphs 1 to 10, wherein the gate is self-closing.

12. The ladder access system according to any one of paragraphs 1 to 11, wherein the first and second side rails are formed of welded pipes.

13. The ladder access system according to any one of paragraphs 1 to 12, further comprising: a first gap filling rail disposed on the first side rail and extending perpendicular therefrom; and a second gap filling rail disposed on the second side rail and extending perpendicular therefrom.

14. A ladder access system, comprising: a clamp disposed on a base proximal an excavation end of the base, the clamp having an excavation side and a surface side configured to extend over an excavation support structure such that the excavation support structure is interposed therebetween; a biasing device coupled to the surface side of the clamp and configured to place the excavation side in biasing engagement with a front side of the excavation support structure, thereby securing the clamp thereto; a first side rail disposed on a first side of the base and a second side rail disposed on a second side of the base; a gate disposed proximal a surface end of the base and extending between the first and second side rails; a ladder support disposed proximal the excavation end of the base and extending from the first or second side rail, the ladder support being configured to uphold an upper end of a ladder disposed in an excavation and leaning thereupon; and a stop disposed on an end of the ladder support, the stop being configured to prevent a ladder from sliding off the ladder support.

15. The ladder access system of paragraph 14, wherein the excavation support structure is a trench shoring wall, a trench shield wall, an aluminum trench box wall, a shoring panel, or a slide rail panel.

16. The ladder access system of paragraph 14 or 15, further comprising eyelets secured to the clamp and disposed through the floor.

17. A method for preventing falls from ladder access points in an excavated area, comprising: disposing an excavation side of a clamp on a front side of an excavation support structure, the clamp being secured to a base proximal an excavation end of the base, wherein the base has first and second side rails disposed on opposing sides of the base and a gate disposed on one of the side rails adjacent a surface end of the base; disposing a surface side of the clamp proximate a back side of the excavation support structure such that excavation support structure is at least partially interposed between the excavation and surface sides of the clamp; securing the clamp to the excavation support structure; and securing a ladder support to one of the side rails proximal the excavation end of the base.

18. The method of paragraph 17, wherein securing the clamp to the excavation support structure comprises actuating a biasing device disposed through the surface side of the clamp to force the excavation side into biasing engagement with the front side of the excavation support structure.

19. The method of paragraph 17 or 18, further comprising: leaning an upper end of a ladder on the ladder support, wherein a lower end of the ladder extends into the excavated area below; and securing the upper end of the ladder to the ladder support.

20. The method according to any one of paragraphs 17 to 19, wherein disposing the excavation side of the clamp on the front side of the excavation support structure comprises: attaching lifting equipment to one or more eyelets fastened to the clamp, the lifting equipment being configured to lift the clamp; and positioning the clamp over the excavation support structure such that the excavation support structure is at least partially interposed between the excavation and surface sides of the clamp.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A ladder access system, comprising:

a base having at least four sides, wherein a first side is opposite a second side and a third side is opposite a fourth side;

a clamp mechanism mounted on and beneath the first side of the base, the clamp mechanism comprising:

two generally parallel rails defining a mounting surface therebetween; and a biasing device for moving to or from one of the generally parallel rails;

a first side rail disposed on the third side of the base;

a second side rail disposed on the fourth side of the base, a pair of generally vertical posts extending from the third side of the base, a pair of generally vertical posts extending from the fourth side of the base, a first generally horizontal top post coupled to and extending between the generally vertical posts on the third side of the base;

a second generally horizontal top post coupled to and extending between the generally vertical posts on the fourth side of the base;

a gate disposed adjacent the second side of the base and mounted on one of the generally vertical posts distal from the clamp, the gate configured to control access to and from the base;

a grated floor disposed on the base; and a ladder support arm mounted to and extending from the first or second generally horizontal top post adjacent the first side of the base, wherein the ladder support arm is substantially orthogonal to the parallel rails of the clamp mechanism, wherein the ladder support arm is an elongated member that telescopically slides in and out of one of the first or second generally horizontal top posts.

2. The ladder access system of claim 1, wherein the grated floor is removeable.

3. The ladder access system of claim 1, wherein the ladder support arm has a stop disposed thereon to prevent a ladder from sliding off the ladder support arm.

4. The ladder access system of claim 1, wherein the ladder support arm is disposed at a height of about 0.9 meters or more above the base.

5. The ladder access system of claim 1, further comprising one or more eyelets secured to the clamp, the eyelets for lifting the ladder access system.

6. The ladder access system of claim 1, wherein the gate is self-closing.

7. The ladder access system of claim 1, wherein the first and second side rails are welded pipes.

8. The ladder access system of claim 1, further comprising:

a gap filling rail disposed on the first side rail, wherein the gap filling rail includes a horizontal portion and a vertical portion, and wherein the horizontal portion of the gap filling rail is generally perpendicular to the front post and generally perpendicular to the top post.

9. A ladder access system, comprising:

a base having at least four sides, wherein a first side is opposite a second side and a third side is opposite a fourth side;

a clamp mechanism mounted on and beneath the first side of the base, the clamp mechanism comprising:

two generally parallel rails defining a mounting surface therebetween, and a biasing device for moving to or from one of the rails;

a first side rail disposed on the third side of the base;

a second side rail disposed on the fourth side of the base;

a pair of generally vertical posts extending from the third side of the base;

a pair of generally vertical posts extending from the fourth side of the base;

a first generally horizontal top post coupled to and extending between the generally vertical posts on the third side of the base;

a second generally horizontal top post coupled to and extending between the generally vertical posts on the fourth side of the base;

a midrail disposed between the base and each top post, wherein the midrails and the top posts are generally parallel;

a gate disposed adjacent the second side of the base and mounted on one of the generally vertical posts distal from the clamp, the gate configured to control access to and from the base;

a grated floor disposed on the base;

a ladder support arm mounted to and extending from the first or second generally horizontal top post adjacent the first side of the base, wherein the ladder support arm is substantially orthogonal to the parallel rails of the clamp mechanism and is at a height of about 0.9 meters or more above the base, wherein the ladder support arm is an elongated member that telescopically slides in and out of one of the first or second generally horizontal top posts; and a stop disposed on an end of the ladder support arm, the stop being configured to prevent a ladder from sliding off the ladder support.

10. The ladder access system of claim 9, further comprising eyelets secured to the clamp and disposed through the grated floor.

* * * * *